US005398631A

United States Patent [19]

Miller

[11] Patent Number: 5,398,631

[45] Date of Patent: Mar. 21, 1995

[54] WATERCRAFT HULL PROTECTOR

[76] Inventor: Kerry Miller, Rte. 11 Box 125A-43, Lubbock, Tex. 79407

[21] Appl. No.: 204,589

[22] Filed: Mar. 1, 1994

[51] Int. Cl.[6] ..... B63B 59/02

[52] U.S. Cl. ..... 114/219; 405/1

[58] Field of Search ..... 114/219, 343, 344, 357, 114/361; 405/1, 7; 188/32

[56] References Cited

U.S. PATENT DOCUMENTS

| | | | |
|---|---|---|---|
| 3,055,022 | 9/1962 | Vallquist | 114/343 |
| 4,696,250 | 9/1987 | Antonides | 114/343 |
| 4,762,080 | 8/1988 | Pearson | 114/219 |
| 4,803,942 | 2/1989 | Dren | 114/219 |
| 4,815,412 | 3/1989 | Cassaro, Jr. | 114/343 |
| 4,909,172 | 3/1990 | Hamby | 114/219 |
| 4,962,719 | 10/1990 | Hughes | 114/343 |

*Primary Examiner*—Stephen P. Avila
*Attorney, Agent, or Firm*—Novak, Vickers & Burt

[57] ABSTRACT

A watercraft hull protector for preventing damage to the lower bow surface of a waterborne craft such as a boat or jet ski, comprising a thin, elongated, flexible, but waterproof sheet-like member having a length substantially greater than the width thereof, and capable of being wound into a roll along the elongated length thereof for storage purposes. An elongated cord element coupled through a grommet located adjacent the center of a reinforced portion extending transversely across the front end portion of the sheet-like member facilitates deploying the mat on the shoreline with a substantial portion of the sheet-like member extending out of the water, traversing the muddy, rocky portion of the bank adjacent the water line, and with the rear end portion of the mat submerged below the water line. An elongated weight extending transversely across the rear end exerts a downward force on the rear end portion of the sheet-like member to retain the rearward portion of the mat in position submerged below the water line. The sheet-like member includes a surface for engagement with the beach, and an upper nonslip surface upon which a user can step while moving between the shore and the craft without treading on the muddy, rocky soil of the bank. The protector, when deployed, supports the hull of the waterborne craft and protects the hull of the craft when the craft is manipulated onto the protector during beaching.

20 Claims, 3 Drawing Sheets

WATERCRAFT HULL PROTECTOR

BACKGROUND OF THE INVENTION

1. Field of Invention

This invention relates to portable boat landing devices, and more particularly to watercraft landing devices for protecting the keel and hull of watercraft such as boats, jet skis, and other waterborne craft from damage during beaching operations, and which is usable by a user of the jet ski or a crew member of the boat to traverse across the muddy or rocky shoreline adjacent the water line as they pass between the shore and the watercraft without the user or crew member having to tread through the muddy or rocky soil of the bank 2. Description of the Background The number of pleasure craft, and especially fishing boats have increased dramatically as a result of more leisure time being available for people who enjoy water sports. At the same time, the average price of a boat has increased, and boats suitable for water activities such as bass fishing can cost as much as $5,000 to $25,000. Other hulled pleasure craft, especially jet skis, have also seen a dramatic rise in their popularity, and also represent a substantial investment in the range of $4,200 to 6,400 for seated models, and even $5,400 or more for stand-up model jet skis. Consequently, with the substantial investment which many owners have in their pleasure craft, owners feel a need to protect their investment from damage. Secondly, leisure activities may encompass festive occasions or scenic tours, for which users may on occasion wear dress clothing Therefore, owners may additionally feel a need to preclude users with dress shoes, or those without suitable boots or wading gear from having to get their feet wet or muddy. In addition, users of jet skis commonly have bare feet, and owners may also feel a need to preclude jet ski users from having to tread across muddy, or in particular, rocky soil of the bank lying immediately adjacent the water line in order to reach the shore.

One of the situations with which a hulled watercraft owner is often faced, is the necessity of beaching the watercraft. This may occur because a problem has occurred with the watercraft, or the owner wants to land the watercraft to picnic, prepare a fire to cook a meal, or because nightfall is approaching and the owner wants to set up camp for the night, or for example, just because the watercraft owner wanted to land at that particular point and admire the view or explore the vicinity. However, many shorelines are covered with rocks, and consequently, if the watercraft is beached in this area, the hull of the craft would be damaged. Further, once the watercraft is beached, the watercraft is often subject to buffeting by turbulent water conditions due to currents, waves and swells. This buffeting which occurs can cause damage to the hull of the watercraft in a short period of time, particularly when rocks or other hazards are present. Because of the possibility of damage to the hull of the watercraft, some fishermen take the precaution to anchor or tie up their craft off the shore in several feet of water, and wade ashore.

Because of the potential damage that might occur to the hull of the watercraft during beaching, a need exists (K.M.) for protective devices which would protect the hull during beaching. One early protective hull device described in U.S. Pat. No. 3,055,022 provides an apron which is positively held in position by securing lines and water scoops against the forward, lower bow portion of the boat as the boat moves in a forward direction through the water, and which is thus positioned for use as a protective device when the craft is beached. Another protective hull device described in U.S. Pat. No. 4,815,412 discloses a protective device in which a sheet is positively held in position by securing lines against the forward, lower bow portion of the boat as the boat undergoes transit through the water, and which utilizes a weight disposed at a rear edge of the sheet to exert a rearward, downward and centering force on the sheet when the vessel is moving in a forward direction through the water. However, such devices create drag when the watercraft is moving, and thus both slow the watercraft and lead to increased fuel consumption, and provide no apparatus wherein crew members of the watercraft may embark or disembark from the craft without having to wade ashore or tread on the muddy or rocky soil of the bank adjacent the shore's water line. Because some boat owners may dress in clothing which they do not wish to have soiled, or the boat owner on occasion may not desire to become wet because of cold or other inclement condition, apparatus which would facilitate embarking or disembarking from the craft without having to wade ashore or tread on the muddy or rocky soil of the bank is desirable. Further, because users of jet skis may commonly have bare feet, apparatus which would facilitate embarking or disembarking from jet skis without having to wade ashore or tread across muddy or, in particular, rocky soil is also desirable.

SUMMARY OF INVENTION

Therefore, it is a primary aim of the present invention to provide a novel watercraft hull protector which may be deployed transversely across the muddy or rocky soil of the bank lying adjacent the water line of the shore as the waterborne craft nears the shore, and upon which the craft may be beached to support and protect the hull of the waterborne craft from damage, and which may be utilized by a user of the waterborne craft to facilitate movement between the shore and the craft without the necessity of having to tread on the muddy or rocky soil of the bank lying adjacent the water line. Another aim of the present invention is to provide a novel, portable watercraft hull protector which may be carried within the craft in a storage configuration as the waterborne craft travels through the water, and which may be deployed by the user in its protective configuration lying transversely across the muddy or rocky soil of the bank when the craft reaches the landing site, and which may be returned to its storage configuration when the waterborne craft is backed into the water, and stored for future use.

In accordance with these aims, the watercraft hull protector of the present invention provides a thin, elongated, flexible, but waterproof sheet-like member having a length substantially greater than the width thereof, which is capable of being fashioned into a compact configuration for storage purposes. An elongated cord element coupled adjacent the center of a reinforced portion extending transversely across the front end portion of the sheet-like member facilitates deploying the mat on the shoreline in its protective configuration with a substantial portion of the sheet-like member extending out of the water, traversing the muddy or rocky portion of the bank adjacent the water line, and with the rear end portion of the mat submerged below the water line. An elongated weight extends transversely across the rear end portion of the sheet-like member to exert a downward force on the rear end portion of the sheet-like member and acts to retain the rearward portion of the mat in position submerged below the water line.

The sheet-like member includes a lower generally planar surface for engagement with the beach, and an upper, non-slip or textured surface upon which the user or crew member can step while moving between the shore and the waterborne craft without having to tread on the muddy or rocky soil of the bank adjacent the water line. Occasionally, users or crew members may wear dress clothing because of some festive occasion or scenic tour, or the user may not be in the possession of waterproof boots. Advantageously, the deployment of the watercraft hull protector of the present invention across the muddy or rocky area of the bank, which provides a dry walking path over the muddy or rocky area, will benefit in precluding users with dress shoes, or those without suitable boots from having to get their feet wet or muddy. In addition, the deployment of the watercraft hull protector of the present invention across the muddy or rocky area of the bank, which provides a walking path over the muddy or rocky area, will benefit in precluding users, in particular of jet skis, who have bare feet from having to walk across muddy or, in particular, rocky soil lying immediately adjacent the water line.

The protector, when deployed, supports the hull of the waterborne craft and protects the hull of the waterborne craft when the waterborne craft is manipulated onto the protector during beaching. When the waterborne craft is backed off the protector, the watercraft hull protector may be retrieved and returned to its storage configuration.

DESCRIPTION OF THE PREFERRED EMBODIMENTS

Figure 1:
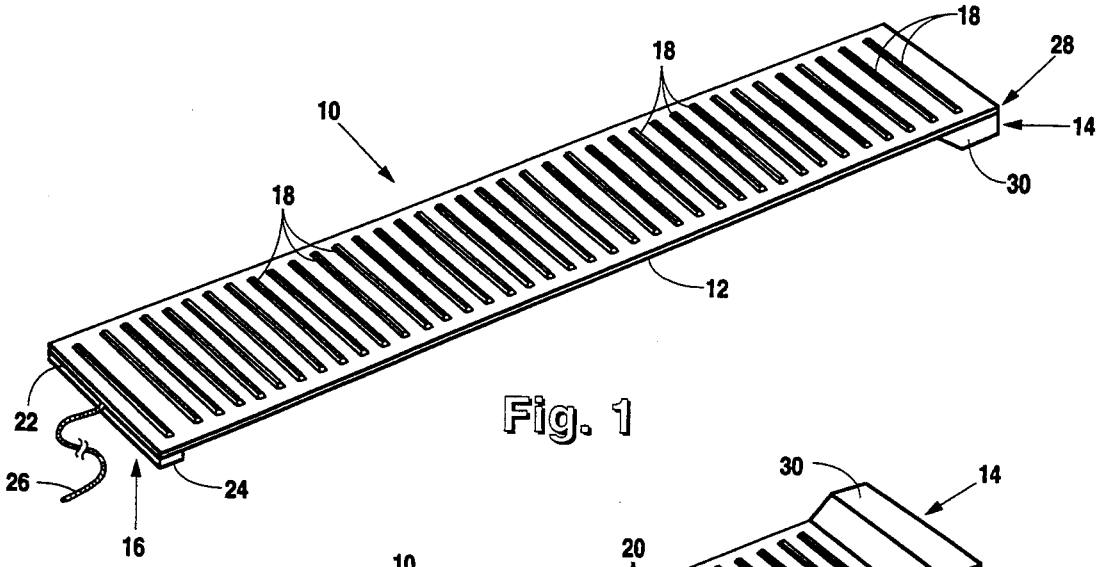
FIG. 1 is a top perspective view of the watercraft hull protector of the present invention.
Figure 2:
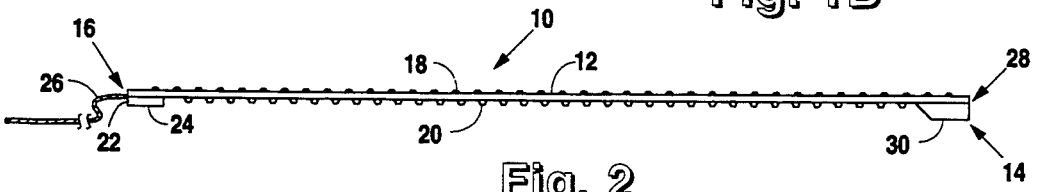
FIG. 2 is a side view of the watercraft hull protector embodiment illustrated in FIG. 1.

Referring to FIGS. 1 and 2, the watercraft hull protector of the present invention is illustrated generally as 10, and includes a thin elongated, flexible and waterproof sheet 12, a weighted portion 14, which extends transversely across the narrow, rear end of sheet 12, and a reinforced portion 16, which extends transversely across the narrow, front end of sheet 12. Waterproof sheet 12 may be suitably fabricated from flexible, comparatively heavy sheet stock, such as rubber or plastic, which is durable for repeated use. Specifically waterproof sheet 12 has a length which is substantially greater than the width thereof. For many waterborne craft sizes, a sheet size of approximately 8" and a width of approximately 16" offers satisfactory protection from damage such as scratching and marring, which may occur when the craft is beached. For others, a sheet size of approximately 10" and a width of approximately 24" offers satisfactory protection from damage, which may occur when the craft is beached. For other larger craft, a sheet size of approximately 12" and a width of approximately 32" offers satisfactory protection from damage.

Quick storage and deployment of watercraft hull protector 10 for use is an important convenience feature to users, which allows the user to quickly store hull protector 10 until it is ready for use. Because waterproof sheet 12 is made from a flexible material, waterproof sheet 12 is capable of being quickly and easily fashioned into a compact configuration for storage purposes, which easily allows for rapid and easy deployment of hull protector 10. Two storage configurations of which waterproof sheet 12 may be quickly and easily fashioned for storage and rapid deployment are (1) a rolled configuration, in which shore mat 10 is wound into a roll along the elongated length of sheet 12; and (2) a folded, rectangular configuration, in which sheet 12 is folded into a rectangular shape. For owners of jet skis, or other waterborne jet craft, the compact size in which hull protector 10 may be stored is of importance, as the storage area available in jet skis or other similar waterborne jet craft may be limited, and hull protector 10 may have to compete with other items for storage space.

Non-slip means extends along the upper, planar surface of sheet 12 to provide a non-slip or textured surface upon which a user or crew member can step while moving between the shore and the waterborne craft without having to tread across the muddy or rocky soil of the bank adjacent the water line. Referring to FIG. 1, non-slip means may be provided in the form of a series of parallel, narrowly spaced elongated ribs 18, which extend transversely across the upper elongated length of sheet 12. Preferably, ribs 18 may be formed integral with waterproof sheet 12 by fabrication methods such as molding or by inscribing transversely across the upper surface of sheet 12 a series of parallel, narrowly spaced, elongated cut channels, such that each pair of spaced channels define an elongated rib 18 therebetween. However, it is within the scope of the invention that non-slip means may be provided in other suitable forms, such as cross-hatching, or a series of closely spaced nubs which extend over the upper surface of sheet 12, or other indentations such as swirls which provide an anti-slip surface across the upper surface of sheet 12.

Figure 1A:
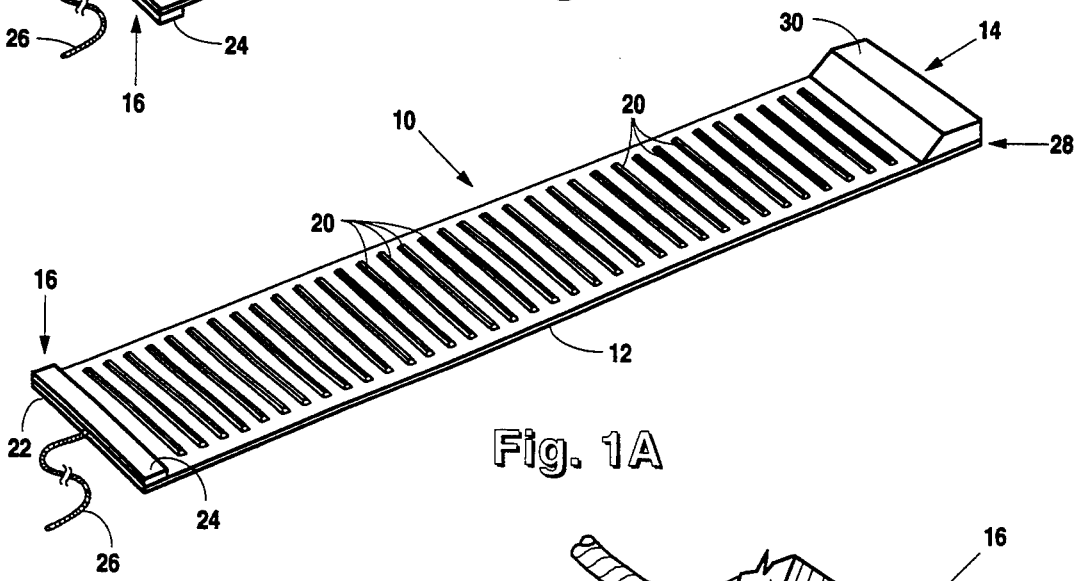
FIG. 1A is a bottom perspective view of the watercraft hull protector embodiment illustrated in FIG. 1.
Figure 1B:
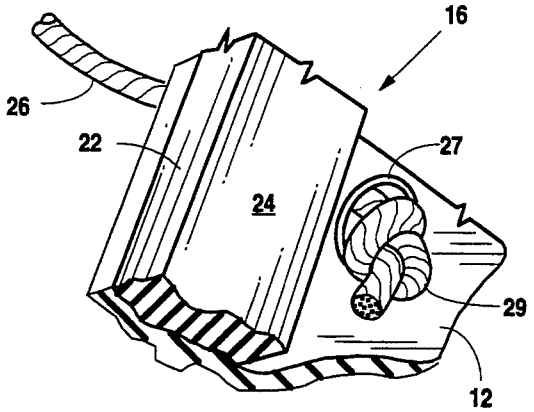
FIG. 1B is a detailed, perspective view showing a second form of coupling an elongated cord element to the watercraft hull protector embodiment illustrated in FIG. 1.

Watercraft hull protector 10 is provided with another generally planar surface which extends over the lower or bottom portion of sheet 12, and which may be in the form of a non-slip or textured surface that is adapted to provide a non-slip engagement with the beach. Referring to FIG. 1A, the non-slip surface may be provided in the form of a series of parallel, narrowly spaced elongated ribs 20, which are similar to ribs 18, and which extend transversely across the lower elongated length of sheet 12. Similarly, ribs 20 may be formed integral with waterproof sheet 12 by fabrication methods such as molding or by inscribing transversely across the lower surface of sheet 12 a series of parallel, narrowly spaced, elongated cut channels, such that each pair of spaced channels define an elongated rib 20 therebetween. However, it is within the scope of the invention that a lower non-slip surface may be provided in other suitable forms, such as cross-hatching, or a series of closely spaced nubs which extend over the lower surface of sheet 12, or other indentations such as swirls which provide an anti-slip surface across the lower surface of sheet 12.

Referring to FIGS. 1A and 2 for details, reinforced portion 16 extends transversely across the front portion of hull protector 10. As illustrated in FIG. 1, the forward edge 22 which extends across the front end portion of hull protector 10 may be straight. Reinforced portion 16 may be provided in the form of a generally thin, elongated, strengthening member 24. Strengthening member 24 may be formed of a suitable non-corrosive resilient material such as stainless steel. Strengthening member 24 extends transversely across the front portion of hull protector 10 along forward edge 22, and is attached to the front portion of sheet 12 by suitable means such as bonding, screws or rivets, not illustrated in the figures. Alternately, for example, reinforced portion 16 may be provided in the form of an elongated, thickened portion which is molded integral with sheet 12, and which similarly extends transversely across hull protector 10 along forward edge 22 of the front end portion of hull protector 10. Preferably, reinforced portion 16 should have at least sufficient resilience or provide suitable structural integrity such that the front end portion of hull protector 10 retains its generally flattened integrity and does not readily bend into a U-shape while the user is engaged in the act of deploying the hull protector 10 to its position of use along the shoreline. In this manner reinforced portion 16 aids in the rapid deployment of hull protector 10, as described in detail hereafter.

An elongated cord element or line 26 is coupled to hull protector 10 adjacent the center of forward edge 22, which extends across the forward narrow end of hull protector 10. Cord element 26 facilitates the user placing hull protector 10 on the shoreline of the beach with a substantial portion of hull protector 10 extending out of the water along the shore in a position traversing the muddy or rocky portion of the bank adjacent the water line, with the remaining portion of hull protector 10 submerged below the water line, for purposes described hereafter.

Illustratively, cord element 26 may be coupled to shore mat 10 by disposing one end of cord element 26 between sheet 12 and strengthening member 24, thus allowing cord element 26 to be bonded between sheet 12 and strengthening member 24, or alternately held therebetween by suitable means such as a large staple or other suitable fastener. Alternately, as illustrated in Fib. 1B, cord element 26 may be coupled to hull protector 10 by suitable means such as providing hull protector 10 with a grommet 27, which is pressed into sheet 12 adjacent the center of forward edge 22, through which one end of cord element 26 is inserted, and tied into a knot, illustrated at 29, thus coupling cord element 26 to hull protector 10. Instead of grommet 27, a reinforced area may be provided in the form of, for example, overlapped layers of sheet-like material. The reinforced area surrounds the opening through which cord element 26 is inserted and tied into a knot, and aids in preventing the knot from pulling through the opening.

Elongated weighted portion 14 extends transversely across the narrow, rear end of sheet 12 adjacent the rearward facing edge portion 28 of hull protector 10. Weighted portion 14 has a sufficient mass to exert a sufficient downward force on the rear end of hull protector 10 to retain the rearward portion of hull protector 10 in position submerged below the water line while the waterborne craft is manipulated, variously by motoring, lifting and pulling upward, onto hull protector 10 during beaching procedures, described hereafter. Referring to FIG. 1A, weighted portion 14 may be provided in the form of an elongated stainless steel weight 30, or some other heavier material relative to the density of sheet 12, and which weighs, for example, 2 pounds for smaller versions suitable for use with jet skis, or 3 pounds for larger versions suitable for use with larger watercraft such as a bass fishing boat. Weight 30 extends transversely across the narrow, rear end portion of sheet 12 adjacent rearward facing edge portion 28, and is attached to the rear end portion of sheet 12 by suitable means such as bonding, screws or rivets, not illustrated in the figures. Weight 30 may also be molded into the rear end portion of sheet 12.

Figure 4:
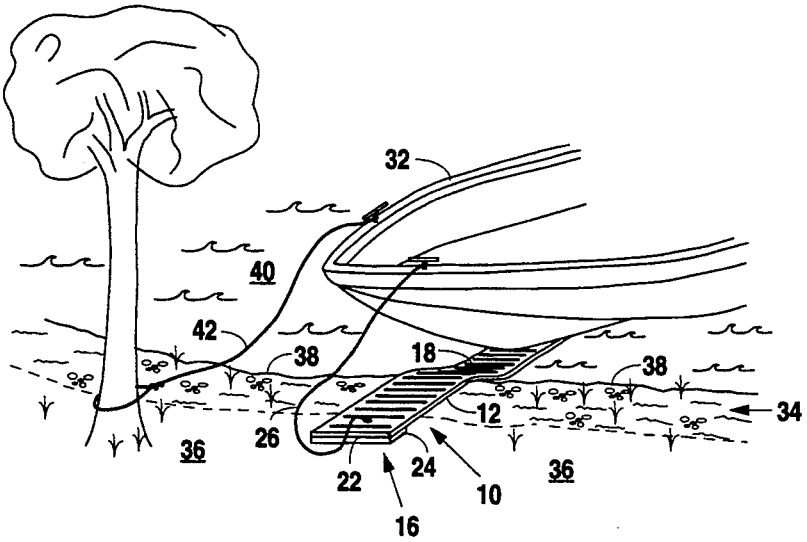
FIG. 4 is a perspective view of the watercraft hull protector embodiment illustrated in FIG. 1 shown in a position of use on the shoreline, with a typical boat hull shown in position for beaching thereon.

Operation of watercraft hull protector 10 will now be explained. Hull protector 10 of the present invention is illustrated as used in conjunction with a bass fishing boat 32. However, it is to be understood that hull protector 10 of the present invention may also be used in a similar manner with other types of pleasure boats and waterborne craft such as a jet ski where it may be desirable to protect the hull during beaching of the craft, or where it may be desirable to facilitate movement between the shore and craft without the necessity of users or crew members having to tread across muddy or rocky soil 34 of bank 36 lying adjacent water line 38, illustrated in FIG. 4 as extending between water line 38 and the phantom line generally parallel to, and spaced from water line 38.

Figure 3:
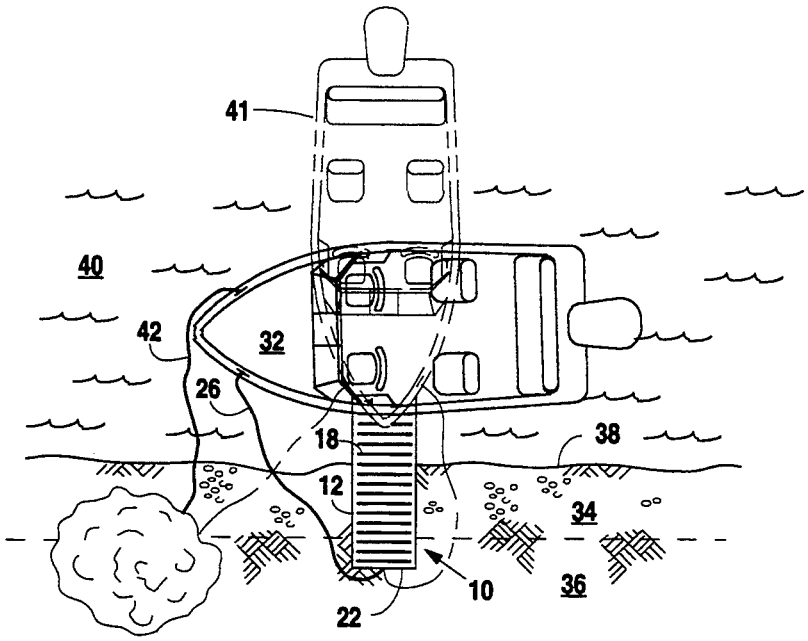
FIG. 3 is a top view of the watercraft hull protector embodiment illustrated in FIG. 1 shown in place on the shoreline and extending downward into the water, with a typical watercraft in the form of a boat deployed in the water generally parallel to the shoreline, with the watercraft hull protector shown deployed by the user of the watercraft transversely across the muddy or rocky soil of the bank, with its weighted end extending downward into the water, and with the boat shown moved to a second position, illustrated in phantom, in which the boat is deployed in general alignment with the watercraft hull protector for beaching.

Prior to deployment, hull protector 10 may be stored in boat 32 in its compact storage configuration while boat 32 travels through water 40 to its destination. Once boat 32 has arrived at its destination, hull protector 10 may be utilized, as illustrated in FIG. 3, by maneuvering, for example, boat 32 into position close to and parallel to shoreline 38. At this point, or at some point in time prior to maneuvering boat 32 into position parallel to shoreline 38, hull protector 10 may be unrolled or unfolded from its storage configuration to its generally flattened configuration, and, for example, laid out on the deck of boat 32 until boat 32 is suitably positioned near shoreline 38. Once boat 32 is suitably positioned adjacent shoreline 38, hull protector 10 may be lowered over the side of the boat and deployed in its protective configuration, as illustrated in FIG. 3, lying transversely across muddy or rocky soil 34 of bank 36 adjacent water line 38 of the shore, in a position with the rearward facing narrow end of hull protector 10 extending downward into water 40.

To deploy hull protector 10 to its protective configuration lying transversely across muddy or rocky soil 34 of bank 36, the user may grasp and employ line 26 to deploy hull protector. 10 in its protective configuration. Once line 26 is grasped, the user may deploy hull protector 10 to its protective configuration by extending his arm outward toward the shore, to its full extension if necessary, and maneuvering boat 32 as necessary toward the shore, thus facilitating deployment of hull protector 10 transversely across muddy or rocky soil 34 of bank 36. In cases in which muddy or rocky soil 34 has an excessive width such that the user cannot successfully reach outward to satisfactorily deploy hull protector 10 in its protective configuration, the user may grasp any portion of elongated sheet 12, especially near its reinforced portion 16, and utilize a throwing or tossing motion to deploy shore mat 10 across muddy or rocky soil 34 of bank 36.

Alternately, for example, hull protector 10 may be deployed in its protective configuration by unrolling or unfolding hull protector 10 from its storage configuration to its generally flattened configuration, and lowering the lower, weighted portion of the hull protector 10 into the water in front of boat 32 as boat 32 approaches the shore. Once the lower weighted portion of hull protector 10 has been lowered into the water, the upper portion of hull protector 10 may be laid on the deck of boat 32, or held by the user until boat 32 reaches shore. The movement of boat 32 through the water retains hull protector 10 in position against the bow of boat 32. Once boat 32 reaches shore, boat 32 can be motored onto shore and beached on hull protector 10. Once boat 32 is suitably beached, the user or crew member can utilize, for example, a throwing or tossing motion, similarly described above, to deploy the remaining portion of hull protector 10 transversely across the muddy or rocky soil 34 of bank 36.

Deployment of hull protector 10 may also be obtained by having someone at the destination point deploy hull protector 10 in its protective configuration across muddy or rocky soil 34 of bank 36 prior to, or contemporaneous with the watercraft reaching its destination, by for example, unrolling hull protector 10 transversely across muddy or rocky soil 34 of bank 36, such that the rearward facing narrow end portion of hull protector 10 extends downward into water 40. This method of deployment may be useful with jet skis or other waterborne jet craft because of their generally small and narrow size and unique seating arrangement Once deployed, weight 30 acts downward to retain the rearward facing end of hull protector 10 submerged in water 40, while the lower antislip surface or textured surface provided by elongated ribs 20 holds hull protector 10 in position, lying transversely across muddy or rocky soil 34 of bank 36, with its lower end submerged in water 40. After deployment of hull protector 10, boat 32 may be maneuvered to a position generally aligned with hull protector 10, as indicated by phantom lines 41 in FIG. 3, and thereafter manipulated onto hull protector 10, thus protecting the hull of boat 32 from damage while boat 32 is beached. Boat 32 may be manipulated onto shore mat 10, for example, as follows: Once hull protector 10 is deployed, the user or crew member may then move boat 32 in an idled motor condition to shore. Boat 32 may be then be beached by motoring boat 32 onto hull protector 10. Alternately, for example, boat 33 may be pulled and lifted into position onto hull protector 10.

Figure 5:
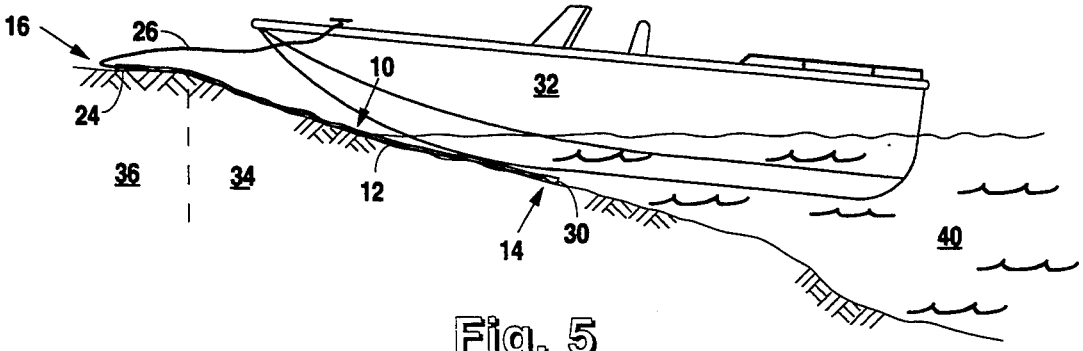
FIG. 5 is a side view of the watercraft hull protector embodiment illustrated in FIG. 1 shown in a position of use on the shoreline, with a typical boat shown beached thereon.

Referring to FIG. 5, soft resilient sheet 12 supports the hull of boat 32 and prevents damage to the hull of boat 32 when boat 32 is manipulated onto hull protector 10 during beaching. Once beached, hull protector 10 continues to protect boat 32 from damage due to buffeting by turbulent water conditions due to currents, waves and swells, which may ordinarily in the absence of protection cause damage to the waterborne craft's hull in a short period of time, particularly when rocks or other hazards are present. A mooring line 42, illustrated in FIG. 4, may be utilized to tie boat 32 to a fixed object on shore, thus preventing boat 32 from accidentally backing off hull protector 10 and drifting downstream. Of course, it is to be realized that motoring boat 32 onto hull protector 10, will relieve the user from the necessity of having to potentially wade in water 40 to assist in pulling and lifting boat 32 into position onto hull protector 10. Additionally, motoring jet ski 44 onto hull protector 10, in particular will relieve bare footed users from the necessity of having to walk across mud or rocks as they transit between shore and jet ski 44.

Figure 6:
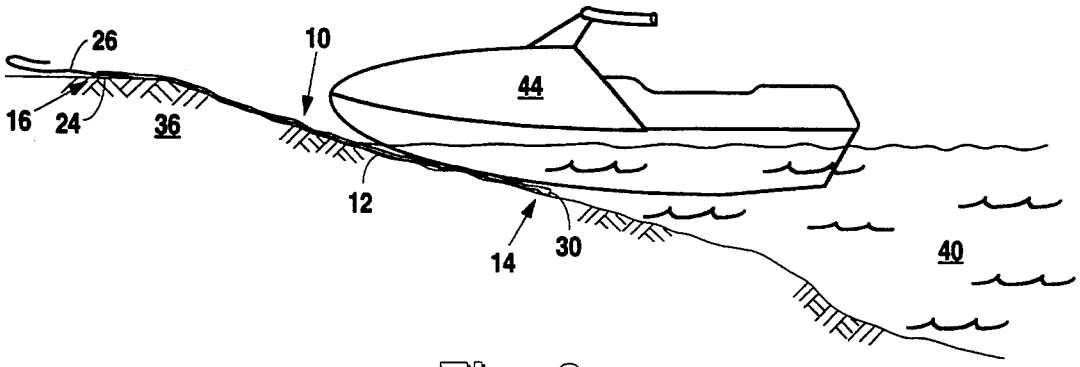
FIG. 6 is a side view of the watercraft hull protector embodiment illustrated in FIG. 1 shown in a position of use on the shoreline, with a typical jet ski shown beached thereon.

Once hull protector 10 is deployed, users or crew members may utilize hull protector 10, as illustrated in FIG. 5, to advantageously facilitate movement between the shore and boat 32 by stepping on the upper, non-slip or textured surface of hull protector 10 provided by elongated ribs 18 and walking over hull protector 10 between the shore and boat 32. In this manner, hull protector 10 may be utilized advantageously by the user to traverse muddy or rocky soil 34 without the user having to tread through muddy or rocky area 34. However, it is to be realized, that facilitation of movement between the shore and boat 32 without the user having to tread through muddy or rocky area 34 adjacent water line 38 may be best realized by motoring boat 32 onto hull protector 10, which will relieve the user from the necessity of: (1) having to potentially wade in water 40 to assist in pulling and lifting boat 32 into position onto hull protector 10, and (2) having to trek across muddy or rocky soil lying adjacent the water line in bare feet, in particular for users of jet skis. Occasionally, users or crew members may wear dress clothing because of some festive occasion or scenic tour, or the user may not be in the possession of waterproof boots. Advantageously, the deployment of hull protector 10 across muddy or rocky area 34 of bank 36 coupled with motoring boat 32 onto hull protector 10 will produce the most benefit in precluding users with dress shoes, or those without suitable boots or wading gear from having to get their feet wet or muddy. Similarly, as illustrated in FIG. 6, the deployment of hull protector 10 across muddy or rocky area 34 of bank 36 coupled with motoring jet ski 44 onto hull protector 10 will benefit in precluding users with bare feet from having to trek across muddy or rocky soil 34.

When boat 32 is to be launched, boat 32 may be motored backwards off hull protector 10, or simply manually pushed off hull protector 10, and hull protector 10 retrieved and returned to its storage configuration. Prior to departure, hull protector 10 may again be stored in boat 32 in its compact storage configuration while boat 32 returns to its launch site, or travels through water 40 to its next destination. Similarly, jet ski 44 may be launched by motoring backwards off hull protector 10, and hull protector 10 retrieved and returned to its storage configuration. Prior to departure, hull protector 10 may again be retrieved, returned to its storage configuration and stored in the cargo compartment of jet ski 44 while jet ski 44 returns to its launch site, or travels through water 40 to its next destination.

As various changes can be made in the above described embodiments without departing from the spirit and scope of the invention, it is intended that all matter contained in the above description or shown in the accompanying drawings shall be interpreted as illustrative and not in a limiting sense.

What is claimed is:

1. Protective watercraft hull apparatus for preventing damage to the lower bow surface of a waterborne craft such as a boat or jet ski, comprising:

a thin, elongated, flexible, but waterproof sheet-like member having a length substantially greater than the width thereof, and capable of being fashioned into a compact configuration for storage purposes, said sheet-like member having an elongated cord element coupled adjacent a front portion that extends across one of the narrow ends of said sheet-like member to facilitate placing said sheet-like member on the shoreline of the beach with a substantial portion of said sheet-like member extending out of the water along the shore in a position traversing the muddy, rocky portion of the bank adjacent the water line, and with the remaining portion of said sheet-like member submerged below the water line, said sheet-like member including a lower planar surface adapted to engage with the beach, an elongated weighted portion extending transversely across said sheet-like member adjacent the rearward facing, opposite narrow end of said sheet-like member, said weighted portion exerting a downward force on the rearward end of said sheet-like member to retain the rearward portion of said sheet-like member in position submerged below the water line, said sheet-like member for supporting the hull of the waterborne craft and protecting the hull of the waterborne craft when the waterborne craft is manipulated onto said sheet-like member during beaching, and means extending along an upper planar surface of said sheet-like member for providing a non-slip surface upon which a user can step while moving between the shore and the waterborne craft without treading on the muddy, rocky soil of the bank adjacent the water line.

2. The protective watercraft hull apparatus of claim 1, wherein said elongated cord extends from the center of a forward edge which extends across said front portion.

3. The protective watercraft hull apparatus of claim 2, wherein said apparatus further comprises a grommet pressed in said sheet-like member adjacent the center of said forward edge.

4. The protective watercraft hull apparatus of claim 3, wherein an end of said cord extends through said grommet, and wherein said end of said cord extending through said grommet is tied into a knot, said knot coupling said cord element to said sheet-like member adjacent said front portion of said sheet-like member.

5. The protective watercraft hull apparatus of claim 2, wherein said forward edge is straight.

6. The protective watercraft hull apparatus of claim 1, wherein said apparatus further comprises a reinforced portion that extends transversely across said front portion.

7. The protective watercraft hull apparatus of claim 6, wherein said reinforced portion includes an elongated, thickened portion molded integral with said sheet-like member and which extends transversely across said sheet-like member along the front edge of said front portion.

8. The protective watercraft hull apparatus of claim 6, wherein said reinforced portion includes a thin, elongated member which is bonded to said sheet-like member and which extends transversely across said sheet-like member along the front edge of said front portion.

9. The protective watercraft hull apparatus of claim 1, wherein said non-slip surface extending along said upper surface of said sheet-like member includes a series of parallel, narrowly spaced elongated fibs, which extend transversely across the upper elongated length of said sheet-like member.

10. The protective watercraft hull apparatus of claim 1, wherein said lower surface of said sheet-like member includes a non-slip surface, said non-slip surface including a series of parallel, narrowly spaced elongated fibs, which extend transversely across the lower elongated length of said sheet-like member.

11. The protective watercraft hull apparatus of claim 1, wherein said compact configuration is a roll, said mat being capable of being wound into said roll along the elongated length thereof for storage purposes.

12. The protective watercraft hull apparatus of claim 1, wherein said sheet-like member is formed from a durable, waterproof rubber-like material.

13. Protective watercraft hull apparatus for preventing damage to the lower bow surface of a waterborne craft such as a boat or jet ski, comprising:

a thin, elongated, flexible, but waterproof sheet-like member having a length substantially greater than the width thereof, and capable of being wound into a roll along the elongated length thereof for storage purposes, said sheet-like member providing a front end portion that extends across one of the narrow ends of said sheet-like member and a rear end portion that extends across the other narrow end of said sheet-like member, said sheet-like member having a reinforced portion that extends transversely across the front end portion of said sheet-like member adjacent the forward edge portion of said front end portion;

a grommet pressed in said sheet-like member adjacent said forward edge portion;

an elongated cord element coupled in said grommet to facilitate placing said sheet-like member on the shoreline of the beach with a substantial portion of said sheet-like member extending out of the water along the shore in a position traversing the muddy, rocky portion of the bank adjacent the water line, and with the rear end portion of said sheet-like member submerged below the water line, said sheet-like member including a lower, generally planar surface for engagement with the beach, an elongated weighted portion extending transversely across the rear end portion of said sheet-like member adjacent the rearward facing, edge of said sheet-like member, said weighted portion exerting a downward force on the rear end portion of said sheet-like member to retain the rearward portion of said sheet-like member in position submerged below the water line, said sheet-like member for supporting the hull of the waterborne craft and protecting the hull of the waterborne craft when the waterborne craft is manipulated onto said sheet-like member during beaching, and a non-slip surface extending along an upper planar surface of said sheet-like member upon which a crew member can step while moving between the shore and the waterborne craft without treading on the muddy, rocky soil of the bank adjacent the water line.

14. The protective watercraft hull apparatus of claim 13, wherein an end of said cord extends through said grommet, and wherein said end of said cord extending through said grommet is tied into a knot, said knot coupling said cord element to said sheet-like member adjacent said front portion of said sheet-like member.

15. A method of beaching a waterborne craft such as a boat or jet ski on a shore and embarking and disembarking from the waterborne craft, comprising the steps of:

positioning an elongated mat transversely across the muddy, rocky soil of the bank lying adjacent the water line of the shore in a position with the rearward facing narrow end of the mat extending downward into the water;

submerging the rearward facing end of the mat below the water and holding the rearward facing end of the mat submerged with a weight attached adjacent the rearward facing, narrow end of the mat;

stepping onto a non-slip surface formed along the upper planar surface of the mat to facilitate movement between the shore and the waterborne craft without treading on the muddy, rocky soil of the bank adjacent the water line; and manipulating the hull of the waterborne craft onto the mat to support and protect the hull of the waterborne craft from damage while the waterborne craft is beached.

16. The method of claim 15, wherein the waterborne craft is a boat, and said step of manipulating includes the step of lifting the hull of the boat onto the mat to support and protect the hull of the boat from damage while the boat is beached.

17. The method of claim 15, wherein the waterborne craft is a boat, and said step of manipulating includes the step of pulling the hull of the boat onto the mat to support and protect the hull of the boat from damage while the boat is beached.

18. The method of claim 15, wherein said step of manipulating includes the step of motoring the waterborne craft onto the mat to support and protect the hull of the waterborne craft from damage while the waterborne craft is beached.

19. The method of claim 15, wherein said step of positioning includes the step of unrolling the mat transversely across the muddy, rocky soil of the bank lying adjacent the water line.

20. The method of claim 15, wherein said step of positioning includes the step of lowering the mat over the side of the waterborne craft as the waterborne craft approaches the shore.

* * * * *